US008752930B2

(12) United States Patent
Doi et al.

(10) Patent No.: US 8,752,930 B2
(45) Date of Patent: Jun. 17, 2014

(54) SUCTION-BASED RECOVERY CONTROL METHOD AND INK JET PRINTING APPARATUS

(75) Inventors: Tsukasa Doi, Kawasaki (JP); Kiichiro Takahashi, Yokohama (JP); Akiko Maru, Tokyo (JP); Takatoshi Nakano, Yokohama (JP); Hiroshi Taira, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 13/316,856

(22) Filed: Dec. 12, 2011

(65) Prior Publication Data

US 2012/0154476 A1 Jun. 21, 2012

(30) Foreign Application Priority Data

Dec. 17, 2010 (JP) ..... 2010-281812

(51) Int. Cl.

| | |
|---|---|
| ***B41J 29/38*** | (2006.01) |
| ***B41J 2/165*** | (2006.01) |
| ***B41J 2/045*** | (2006.01) |
| *B41J 2/19* | (2006.01) |

(52) U.S. Cl.

CPC ..... *B41J 2/04563* (2013.01); *B41J 2/0454* (2013.01); *B41J 2/19* (2013.01)

USPC ..... 347/17; 347/30

(58) Field of Classification Search

CPC ..... B41J 2/04528; B41J 2/04541; B41J 2/16532; B41J 2/04563; B41J 2/19

USPC ..... 347/17, 19, 30

See application file for complete search history.

(56) References Cited

U.S. PATENT DOCUMENTS

| | | | | |
|---|---|---|---|---|
| 6,648,447 | B2 * | 11/2003 | Sugimoto et al. | 347/30 |
| 6,719,400 | B2 | 4/2004 | Inui et al. | |
| 7,207,649 | B2 | 4/2007 | Ide et al. | |
| 7,445,309 | B2 | 11/2008 | Ide et al. | |
| 7,794,044 | B2 | 9/2010 | Yoshikawa et al. | |
| 7,997,681 | B2 | 8/2011 | Yoshikawa et al. | |
| 8,083,311 | B2 | 12/2011 | Ide et al. | |
| 2011/0316906 | A1 | 12/2011 | Taira et al. | |

FOREIGN PATENT DOCUMENTS

| | | |
|---|---|---|
| JP | 2010-052393 | 3/2010 |

* cited by examiner

*Primary Examiner* — An Do

(74) *Attorney, Agent, or Firm* — Fitzpatrick, Cella, Harper & Scinto

(57) ABSTRACT

The amount of ink wastage is reduced, even in a case wherein a predetermined amount of air bubbles has grown in a print head at a specific internal temperature and the growth has been settled, and thereafter the temperature in the print head is increased. A suction-based recovery control method, for an ink jet printing apparatus that includes a print head, a temperature detection unit, and a suction-based recovery unit, comprising: a temperature detection step; a temperature judgment step for judging whether the internal temperature of the print head is higher than a reference temperature that is determined based on internal temperatures of the print head that were previously employed; and a suction-based recovery step for permitting the suction-based recovery unit when it is determined at the temperature judgment step that the internal temperature of the print head is higher by the predetermined number of degrees or greater.

15 Claims, 7 Drawing Sheets

SUCTION-BASED RECOVERY CONTROL METHOD AND INK JET PRINTING APPARATUS

BACKGROUND OF THE INVENTION

1. Field of the Invention

The present invention relates to a suction-based recovery control method and an inkjet printing apparatus, and particularly relates to a suction-based recovery control method and to an ink jet printing apparatus, for detecting the temperature of a print head.

2. Description of the Related Art

With an ink jet printing apparatus, it sometimes occurs that air bubbles grow within ink paths and ink chambers, and during printing, are carried along with the stream of ink to ejection nozzles, where they interrupt the ejection of ink from the print head. To resolve this problem, a known suction-based recovery technology has been applied to periodically perform the mandatory removal of air bubbles, which have grown in the print head, through the side where the ejection nozzles are formed.

An example suction-based recovery control method is disclosed in Japanese Patent Laid-Open No. 2010-052393, according to which, using a control for timer suction-based recovery, a suction operation is performed when a predetermined period of time has elapsed following an immediately preceding suction operation, and the timing for suction-based recovery is advanced as the temperature rises. This technique is provided by focusing on the phenomenon that at higher temperatures, air bubbles grow faster in ink paths.

However, it has been found through study, performed by the inventor of the present invention, that when all of air bubbles have been mandatorily discharged from the print head at a predetermined temperature, almost no more air bubbles grow at that temperature. That is, when the temperature rises by a predetermined number of degrees or greater, beyond the temperature at which all the air bubbles were discharged, i.e., the temperature at which the recovery process was performed, air bubbles again begin to grow, and continue to grow until the total number in the ink paths is once more sufficient to cause an ejection failure, and to therefore require that the suction-based recovery process be repeated.

Therefore, according to the method described in Japanese Patent Laid-Open No. 2010-052393, whereby the suction-based recovery process is advanced merely because the temperature is high, when air bubbles have been mandatorily discharged while the print head is maintained at a high temperature, the frequency at which suction is applied to increased, even though no more air bubble growth occurs. As a result, the amount of ink wastage is increased.

SUMMARY OF THE INVENTION

While taking this problem into account, one objective of the present invention is to provide a suction-based recovery control method and an ink jet printing apparatus, whereby the occurrence of an ejection failure is not occurred and the amount of ink wastage is reduced, even in a case wherein a predetermined amount of air bubbles has grown in a print head at a specific internal temperature and the growth has been settled, and thereafter the temperature in the print head is increased.

To achieve this objective of the present invention, a suction-based recovery control method, for an ink jet printing apparatus that includes a print head having a plurality of ejection ports through which to eject ink droplets, a temperature detection unit for detecting an internal temperature of the print head, and a suction-based recovery unit for performing a suction-based recovery operation using either first suction or second suction, the strength of which is stronger than the first suction, in order to recover a state in which the print head ejects ink droplets, comprising:

a temperature detection step for permitting the temperature detection unit to detect the internal temperature of the print head; a temperature judgment step for judging whether the internal temperature of the print head, detected by the temperature detection unit, is higher, by a predetermined number of degrees or greater, than a reference temperature that is determined based on internal temperatures of the print head that were previously employed when the suction-based recovery operation was performed; and a suction-based recovery step for permitting the suction-based recovery unit to perform the suction-based recovery operation using the second suction, when it is determined at the temperature judgment step that the internal temperature of the print head is higher by the predetermined number of degrees or greater.

According to this structure, the suction-based recovery operation is performed when the internal temperature of the print head exceeds, by a predetermined number of degrees or greater, the highest temperature at which the suction-based recovery operation was previously performed. Therefore, even when the environmental temperature is raised, an ejection failure does not occur due to the amount of air bubbles accumulated in the print head, and the amount of ink wastage is reduced.

Further features of the present invention will become apparent from the following description of exemplary embodiments (with reference to the attached drawings).

DESCRIPTION OF THE EMBODIMENTS

One embodiment of the present invention will be described in detail while referring to the accompanying drawings.

Figure 1:
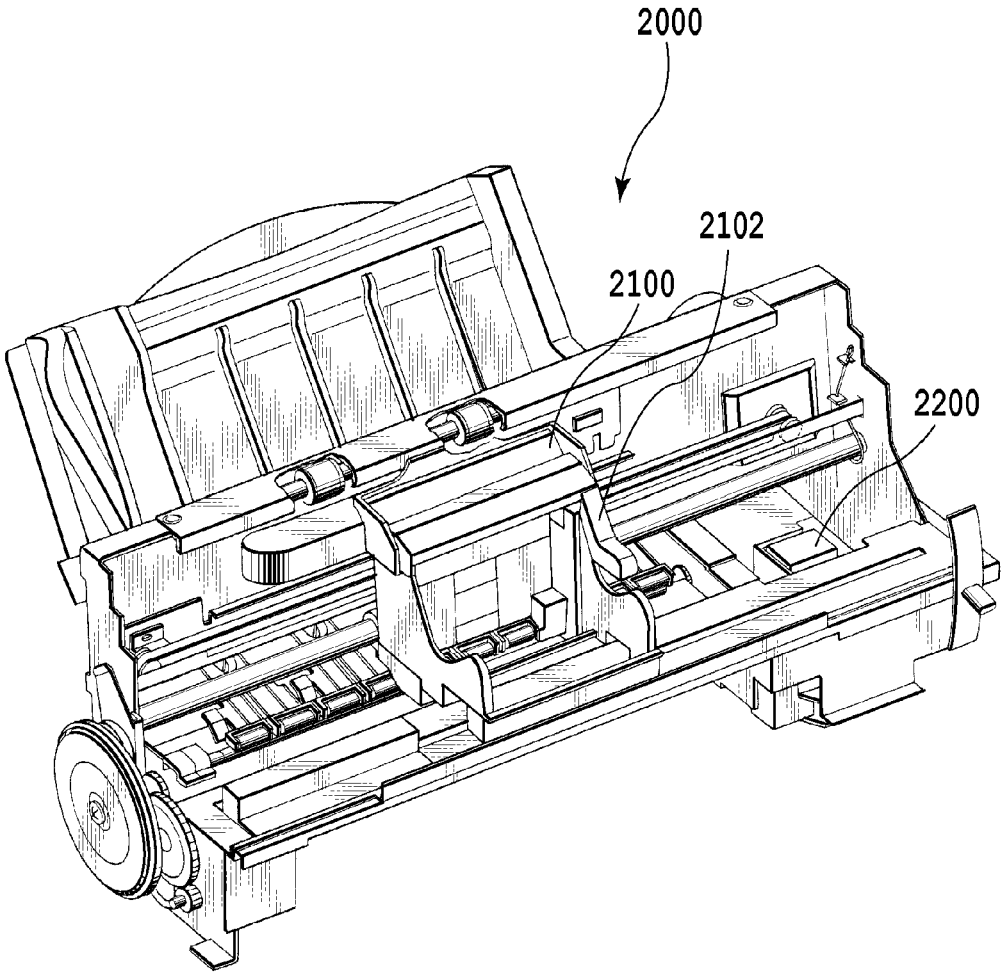
FIG. 1 is a perspective view of a printing apparatus unit according to one embodiment of the present invention.

FIG. 1 is a perspective view of a printing apparatus unit of an ink jet printing apparatus according to the embodiment, with an exterior member being removed. The printing section of a printing apparatus unit 2000 includes a carriage 2100 that is supported, at a carriage shaft 2103, so as to be movable, and a print head 4000 that is detachably mounted on the carriage 2100 and that will be described in detail later while referring to FIG. 2.

Figure 2:
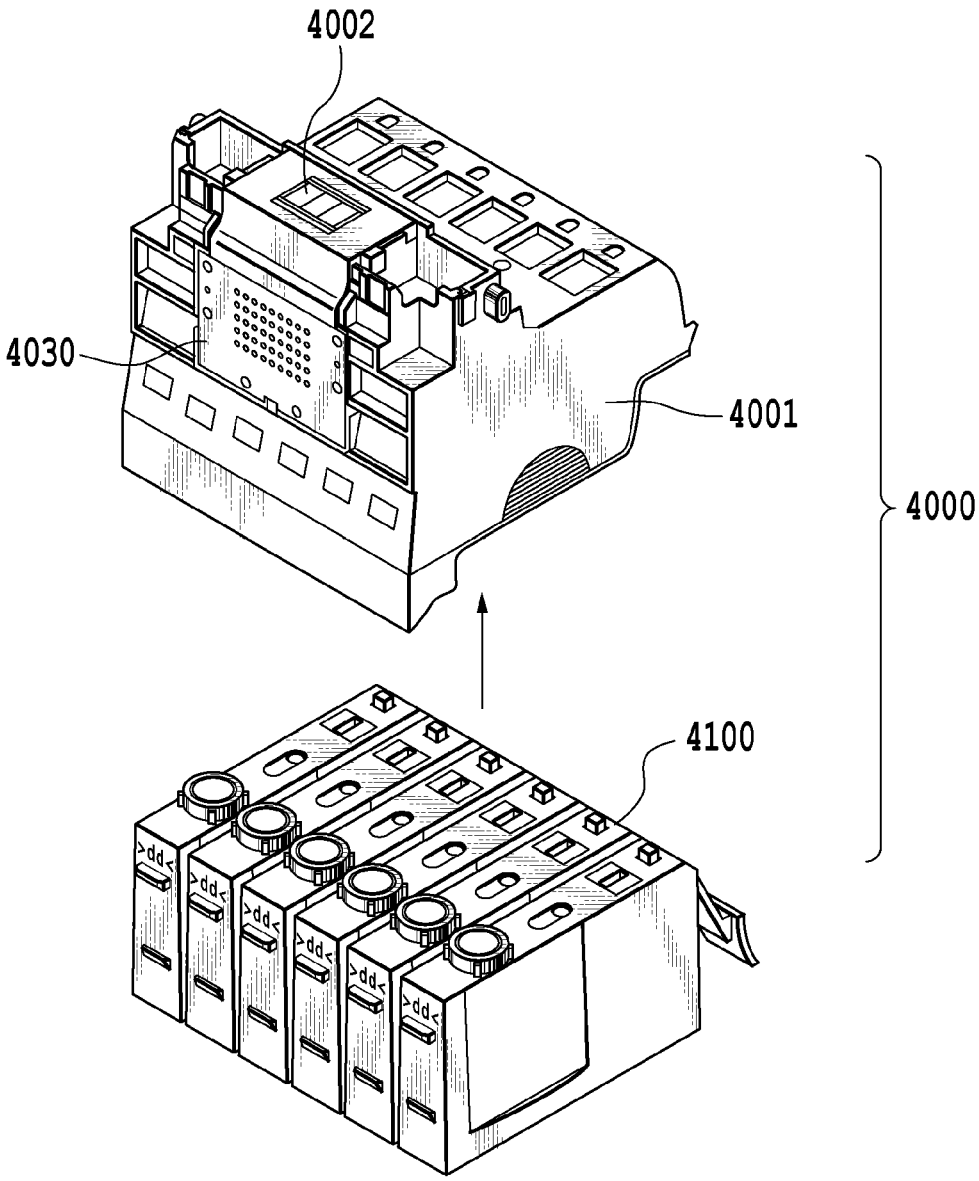
FIG. 2 is a diagram illustrating a print head according to the embodiment.

FIG. 2 is a diagram illustrating a print head according to the embodiment. The print head 4000 for this embodiment includes ink tanks 4100 and a print head main body 4001. In this embodiment, black ink, light cyan ink, light magenta ink, cyan ink, magenta ink and yellow ink are stored respectively in the ink tanks 4100, and these ink tanks 4100 are detachably mounted to the print head main body 4001.

Figure 3:
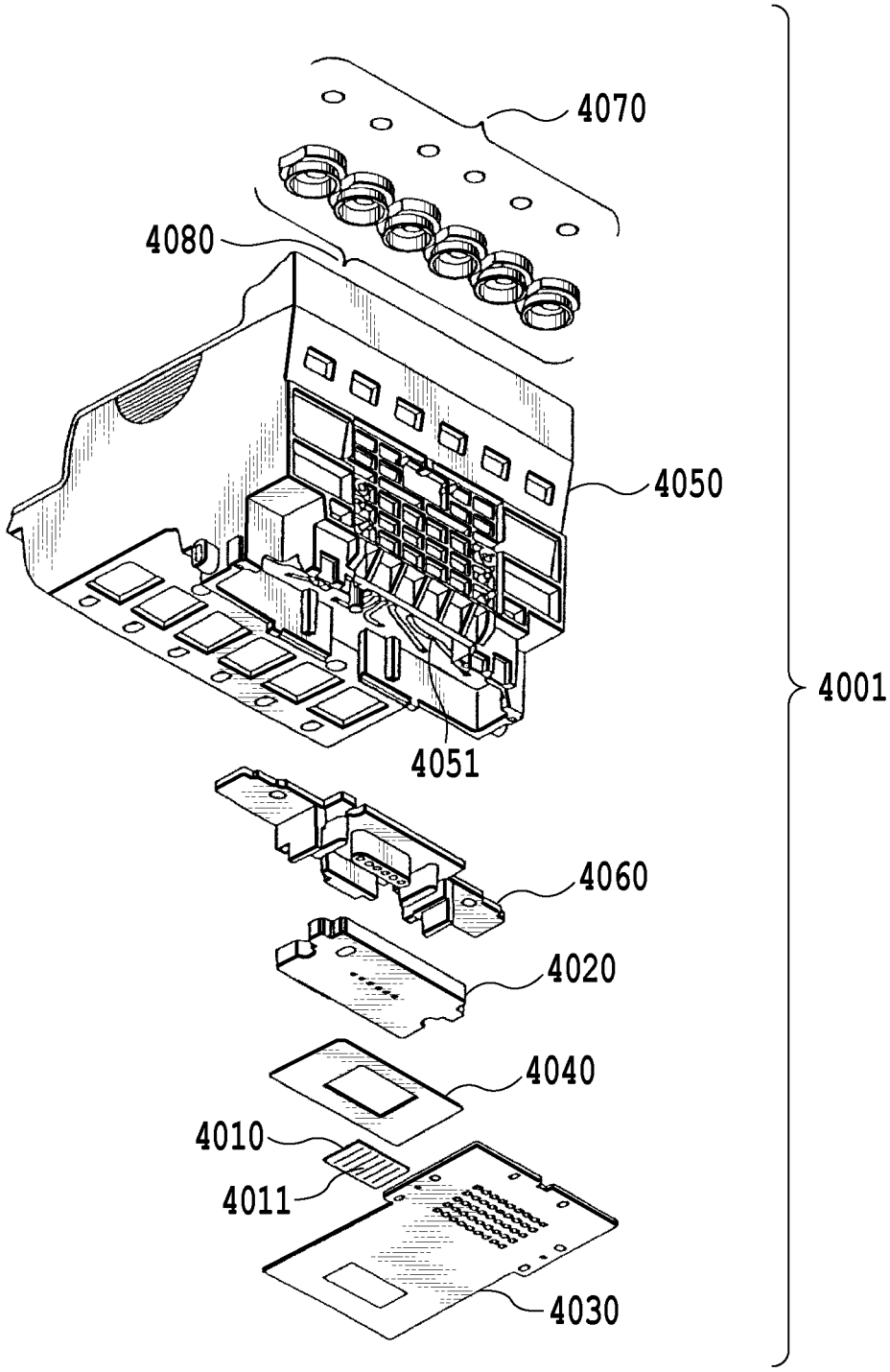
FIG. 3 is an exploded perspective view of the main body of the print head according to the embodiment.

FIG. 3 is an exploded perspective view of the print head main body 4001 according to this embodiment. The print head main body 4001 of this embodiment includes a printing element substrate 4010, a first plate 4020, an electric wiring board 4030, a second plate 4040, a tank holder 4050, an ink path forming member 4060, filters 4070 and rubber seals 4080.

On the printing element substrate 4010, a plurality of printing elements for ejecting ink onto one side of a silicon substrate and electrode wiring, such as aluminum wiring, to supply electric power to the individual printing elements, are formed by the film deposition technique. Further, a plurality of ink paths 4051 and a plurality of nozzles that include ejection ports 4011 are arranged for the printing element substrate 4010, in consonance with the printing elements, and an ink supply port, for supplying ink to the ink paths 4051, is formed in the reverse face. The printing elements employ thermal energy to eject ink, and include electrothermal converters for generating thermal energy. That is, thermal energy generated by the electrothermal converters is employed to cause film boiling of ink, and based on the change of pressure that occurs due to growing or shrinking of air bubbles, ink droplets are ejected through the ejection ports 4011.

The ink path forming member 4060 is securely bonded, using ultrasonic welding, to the tank holder 4050, where the ink tanks 4100 are stored so as to be detachable, and provides the ink paths 4051 that serve as channels for supplying ink from the ink tanks 4100 to the first plate 4020. Furthermore, the filters 4070 are located at the ends of the ink paths 4051 that engage the ink tanks 4100, so that the entry of external dust is prevented.

Figure 4A:
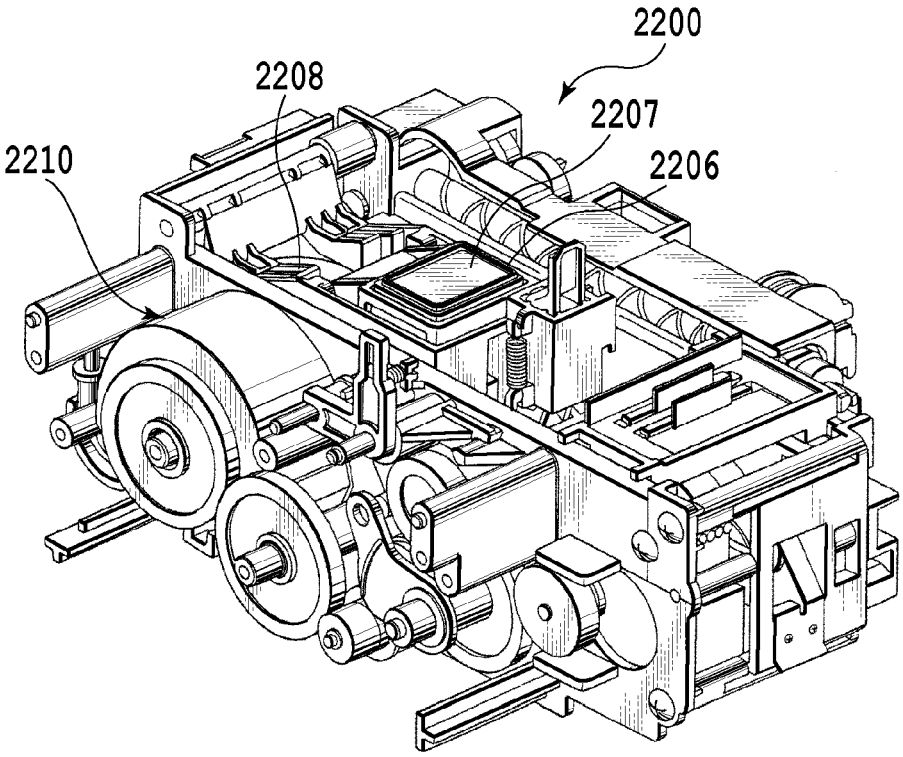
FIG. 4A is a perspective view, taken from one side face, of an ejection recovery unit according to the embodiment.
Figure 4B:
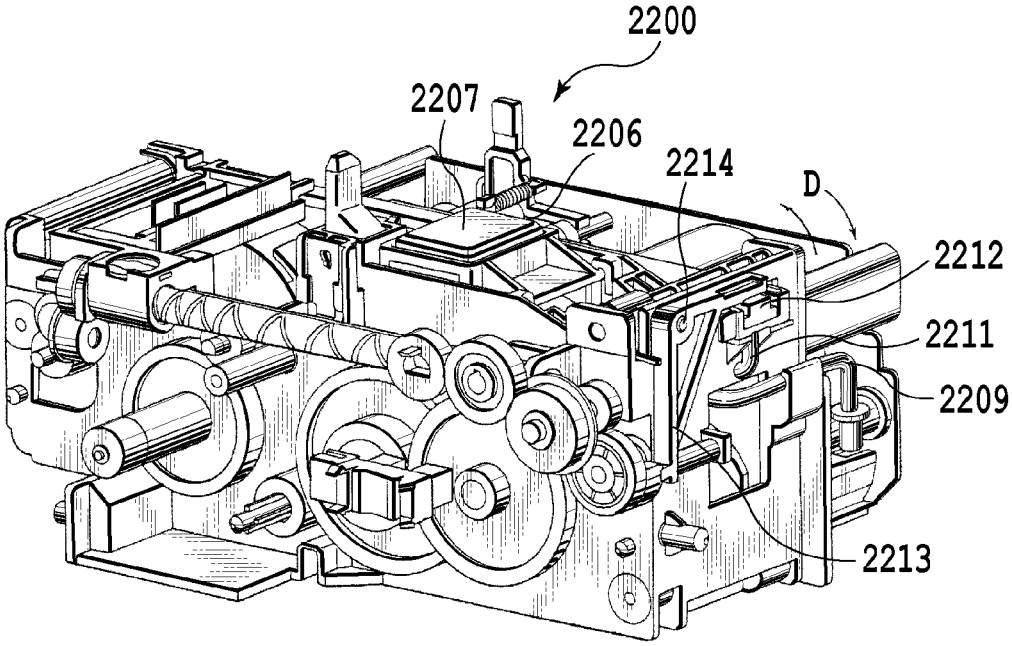
FIG. 4B is a perspective view, taken from the side face opposite the side face in FIG. 4A, of the ejection recovery unit.

FIGS. 4A and 4B are perspective views of an ejection recovery device 2200 for the printing apparatus according to the embodiment. Specifically, FIG. 4A is a perspective view, taken from one side, of the ejection recovery device 2200, and FIG. 4B is a perspective view, taken from the opposite side, of this device 2200. The ejection recovery device 2200 is arranged outside the range wherein the carriage 2100, on which the print head 4000 is mounted, reciprocates for the printing operation, i.e., outside the printing area. The recovery process is performed in order to maintain an appropriate ejection state for the print head 4000. The ejection recovery device 2200 is positioned at a desired location outside the printing area, such as the location correlated with the home position for the carriage 2100 and the print head 4000. Further, the ejection recovery device 2200 of this embodiment is arranged so as to be independently detachable from the main body of the printing apparatus. The ejection recovery device 2200 includes a wiping unit, for removing a foreign substance from the printing element substrate 4010 of the print head 4000, and a suction-based recovery unit, for obtaining the normal state for the supply of ink along the ink paths 4051 from the ink tanks 4100 to the printing element substrate 4010 of the print head 4000.

The suction-based recovery unit includes: a cap 2206 that is made, for example, of rubber and is used to cover the printing element substrate 4010 of the print head 4000; an absorber 2207, provided inside the cap 2206; and an arm 2208, that either brings the cap 2206 into contact with, or separates the cap 2206 from the print head 4000.

The cap 2206 is supported by a holder that is provided separately from the arm 2208, and this holder is held by the arm 2208. The cap 2206 is connected to a pump 2210 via a tube 2209, and when the pump 2210 is operated, ink is drawn, by suction, from the print head 4000 that is covered by the cap 2206. Another tube 2211 having an atmospheric communicating valve 2212 is arranged en route between the cap 2206 and the pump 2210.

The atmospheric communicating valve 2212 is formed, for example, of a rubber based material, and an atmospheric communicating valve arm 2213 that is to be brought into contact with, or separated from, the atmospheric communicating valve 2212, is provided at a shaft 2214 to be rotatable in a direction indicated by D. When the pump 2210 is operated while the atmospheric communicating valve arm 2213 is contacting the atmospheric communicating valve 2212, the suction of ink from the print head 4000 is performed. On the other hands, when the pump 2210 is operated while the atmospheric communicating valve arm 2213 is separated, the suction of ink from the print head 4000 is not performed, even though the cap 2206 is in contact with the print head 4000, and only the ink that is in the cap 2206 is drawn out by suction.

Figure 5:
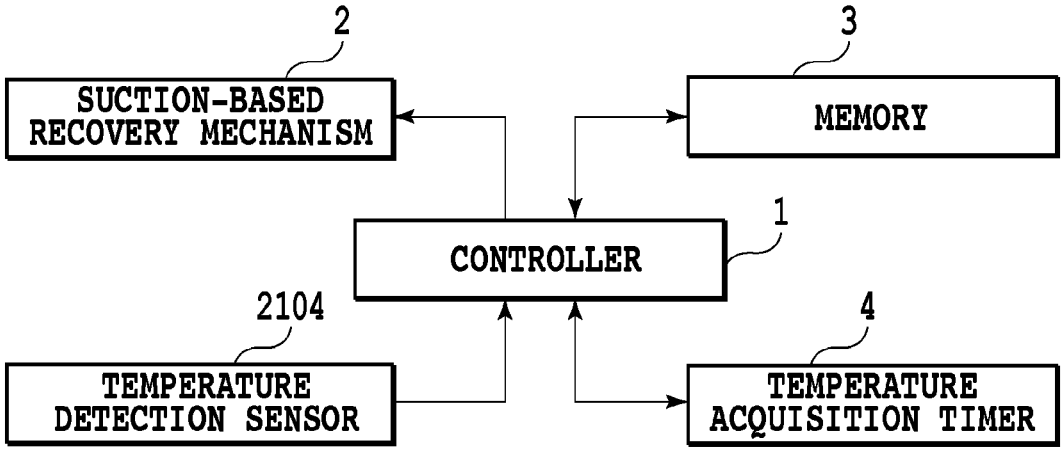
FIG. 5 is a schematic block diagram illustrating the periphery of the controller of the printing apparatus according to the embodiment.

FIG. 5 is a schematic block diagram illustrating the periphery of the controller of the printing apparatus according to this embodiment. A controller 1 transmits an instruction for a suction-based recovery operation to a suction-based recovery mechanism 2, and based on a count value held by a temperature acquisition timer 4, transmits a temperature acquisition instruction to a temperature detection sensor 2104. Then, the controller 1 records, in a memory 3, the internal temperature reading for the print head 4000.

The suction-based recovery mechanism 2 has a function for performing an operation for removing air bubbles using second suction, and a function for removing fixed adhesion ink and dust sticking to the nozzles using first suction, and selects which operation is to be used in accordance with the instruction received from the controller 1. The temperature acquisition timer 4 is used to measure an elapsed time for obtaining the internal temperature of the print head 4000, and begins counting time after the second suction operation has been performed. When printing is first begun or when suction-based recovery is begun after the printing of a predetermined number of pages has been performed, or when the time count value held by the temperature acquisition timer is 24 hours, the temperature detection sensor 2104 receives a temperature acquisition instruction from the controller 1, and thereafter obtains the internal temperature of the print head 4000.

Figure 6:
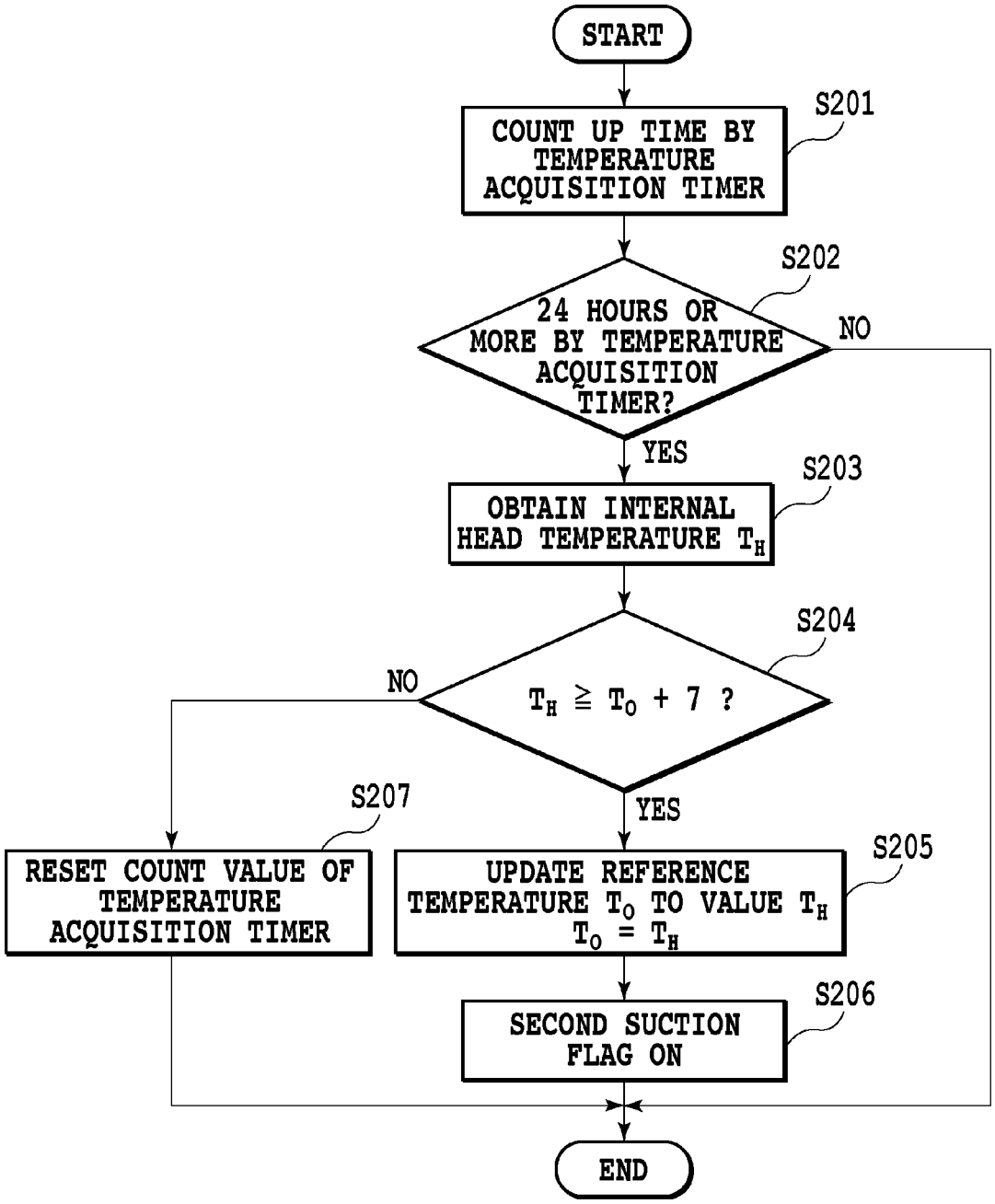
FIG. 6 is a flowchart showing the control processing performed when a temperature acquisition timer is counting up.

FIG. 6 is a flowchart showing the control processing performed while the temperature acquisition timer 4 is counting the elapsed time. When the temperature acquisition timer 4 has counted the elapsed time (step S201), a judgment is performed to determine whether the time count value is 24 hours or more (step S202). When the time count value is less than 24 hours, the control processing being performed, while the temperature acquisition timer 4 is counting the elapsed time, is terminated. When the time count value held by the temperature acquisition timer 4 is 24 hours or more, an internal print head temperature $T_H$ is obtained as a reference temperature $T_0$ (step S203).

In this embodiment, the temperature acquisition time interval is every 24 hours following the preceding performance of a second suction operation. However, the temperature acquisition time for the present invention is not limited to this time interval, and while taking the bubble growth rate into account, any other time interval may be employed. That is, when the interval for the temperature acquisition time is too short, air bubbles might still be growing at the time of the detection of the temperature rise, and therefore, the bubble growth rate must be taken into account.

After the internal print head temperature $T_H$ is obtained (step S203), a judgment is performed to determine whether the internal print head temperature $T_H$ is higher by 7° C. or more than the reference temperature $T_0$ (step S204). When a temperature difference between the internal print head temperature $T_H$ and the reference temperature $T_0$ is found to be smaller than 7° C., the count value produced by the temperature acquisition timer 4 is reset, and the control processing performed, while the elapsed time is being counted, is terminated.

Figure 7:
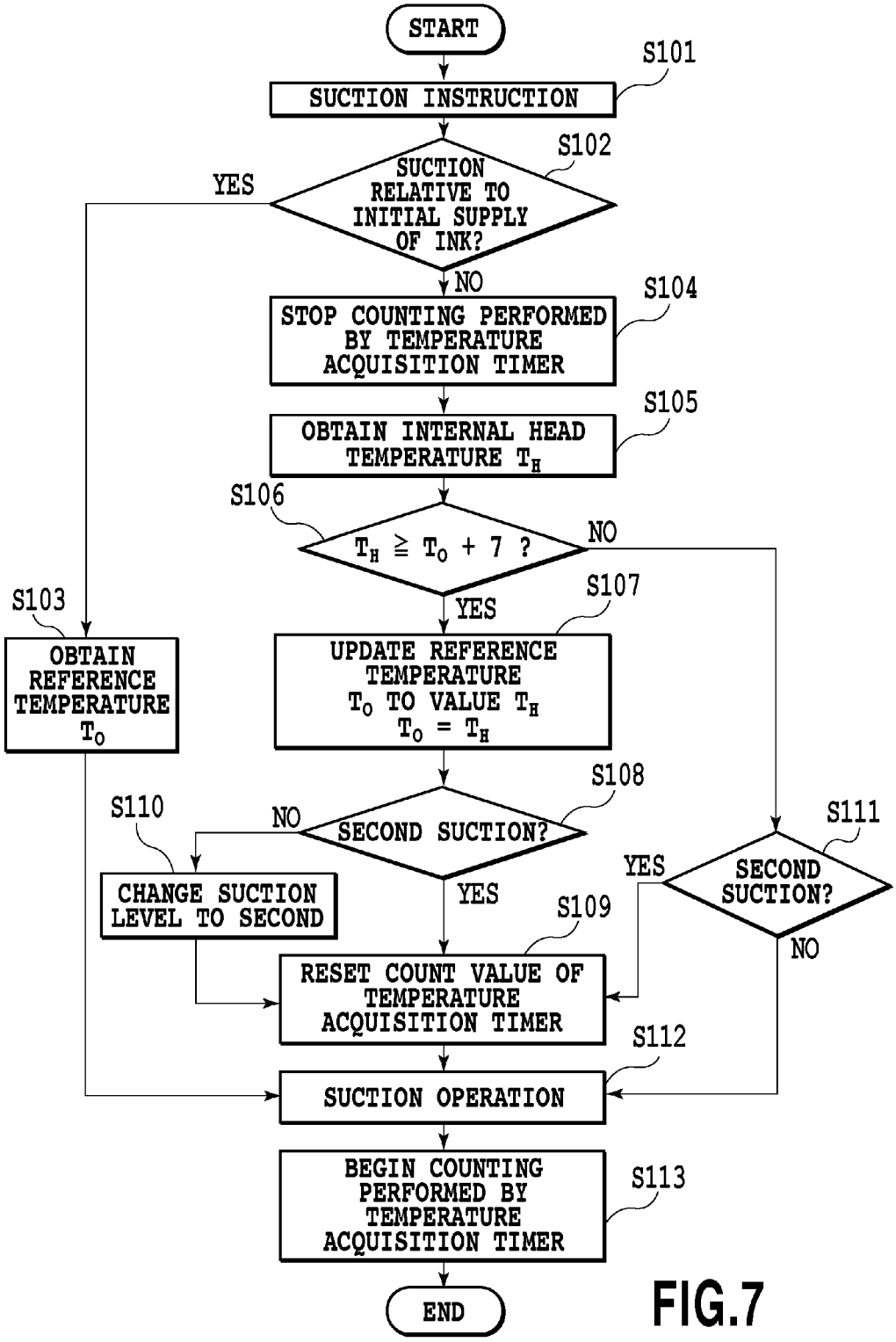
FIG. 7 is a flowchart showing the control performed for the suction-based recovery control operation according to the embodiment.

On the other hands, when the internal print head temperature $T_H$ is higher by 7° C. or more than the reference temperature $T_0$, the reference temperature $T_0$ is updated to the internal print head temperature $T_H$ (step S205), and a second suction flag is set to ON (step S206). Thereafter, the control processing performed while the temperature acquisition timer 4 is counting the elapsed time, is terminated. When the second suction flag has been set to ON during the control processing performed while the temperature acquisition timer 4 was counting the elapsed time, a suction-based recovery operation, which will be described later using FIG. 7, is performed.

It is assumed, for the print head 4000 of this embodiment, that in a case wherein the internal print head temperature $T_H$ obtained at the temperature acquisition time is higher by 7° C. or more than the reference temperature $T_0$ (the maximum temperature that the print head 4000 can reach), there is a possibility that an ejection failure will occur due to the growth of bubbles. However, a difference between the internal print head temperature $T_H$, which may adversely affect ink ejection, and the reference temperature $T_0$ varies, depending, for example, on the members that form a print head, the composition of ink, the lengths and diameters of ink paths and the shape of a liquid chamber located immediately above the nozzles. Therefore, such a difference factor should be determined in advance, based on the structure for which the present invention is applied.

Furthermore, in the process at step S204, a temperature difference between the internal print head temperature $T_H$ and the reference temperature $T_0$ has been employed to determine whether a suction-based recovery operation should be performed. However, a plurality of suction power levels may be provided, and a suction level may be selected in accordance with a temperature difference between the internal print head temperature $T_H$ and the reference temperature $T_0$.

In this embodiment, as described at step S204 and at step S106, which will be described later, a difference between the temperature $T_H$ of the print head 4000, detected by the temperature detection sensor 2104, and the reference temperature $T_0$, obtained at the reference temperature acquisition step, is employed to determine whether a suction-based recovery operation is to be performed.

FIG. 7 is a flowchart showing the suction-based recovery operation performed for this embodiment. First, the controller 1 transmits, to the suction-based recovery mechanism 2, either a suction instruction for an automatic suction-based recovery operation performed when printing is begun or when a predetermined number of pages have been printed, or a suction operation instruction for an operation performed when a second suction flag has been set to ON during the control processing using the timer, as described while referring to FIG. 6, or a suction operation instruction manually entered by a user (step S101). A judgment is then performed to determine whether the suction operation instruction transmitted by the controller 1 is for a suction operation performed relative to the initial ink supply (step S102). A suction operation performed relative to the initial ink supply is a suction-based recovery operation for loading ink into the print head 4000 the first time, and when the suction operation instruction is for a suction operation performed relative to the initial supply of ink, the internal print head temperature at that time is obtained, and recorded in the memory 3 as the first reference temperature $T_0$ (step S103). Then, the suction operation relative to the initial supply of ink is performed (step S112), the counting by the temperature acquisition timer 4 is started (step S113), and the processing is thereafter terminated.

On the other hands, when the suction operation instruction is not for a suction operation relative to the initial supply of ink (step S102), the counting performed by the temperature acquisition timer 4 is halted (step S104), and the internal print head temperature $T_H$ immediately before the suction operation began is obtained (step S105). Then, a judgment is performed to determine whether the internal print head temperature $T_H$ obtained at step S105 is higher by 7° C. or more than the reference temperature $T_0$ (step S106).

When the internal printing head temperature $T_H$ is higher by 7° C. or more than the reference temperature $T_0$, the reference temperature $T_0$ is updated to the internal print head temperature $T_H$ (step S107). This is because, if air bubbles are removed by suction at this temperature, a rapid growth of bubbles will not occur due to an increase in the temperature unless the current temperature is updated.

When the internal print head temperature $T_H$ is higher by 7° C. or more than the reference temperature $T_0$, it is highly probable that the number of air bubbles generated in the print head 4000 has already reached a level that causes an ejection failure, and that therefore, a second suction operation is required, regardless of whether a first or a second suction operation instruction was issued at step S101. Therefore, the level for a suction operation has been determined (step S108), and when an instruction for a second suction operation has already been issued, the suction level is unchanged, while when an instruction for a first suction operation has been issued, the suction level is changed to second (step S110).

In the process at step S110 for judging the suction-based recovery operation, several suction levels may be provided, and a suction level may be selected based on a temperature difference between the internal print head temperature $T_H$ and the reference temperature $T_0$.

When the suction level is changed to second suction (step S110), or when a second suction operation has been designated (step S108), the count value for the temperature acquisition timer 4 is reset, and the suction operation is started (step S112).

When a judgment is performed to determine whether the internal print head temperature $T_H$ is higher by 7° C. or more than the reference temperature $T_0$ (step S106), and when the temperature difference between the internal print head temperature $T_H$ and the reference temperature $T_0$ is determined to be smaller than 7° C. (S111), the level of suction is subsequently examined. When the level of suction is second, the count value for the temperature acquisition timer 4 is reset (step S109), and the suction operation is performed (step S112). However, when the level of suction is first (step S111), the count value of the temperature acquisition timer 4 is not reset, and the suction operation is performed (step S112).

After the suction operation has been performed, the counting by the temperature acquisition timer 4 is started (step S113), and thereafter the suction-based recovery operation for this embodiment is terminated.

As described above, in this embodiment, when the internal temperature of the print head is higher by a predetermined number of degrees or greater than the temperature when the suction-based recovery operation was previously performed, the suction-based recovery operation is performed. Therefore, when the environmental temperature is increased, an ejection failure does not occur because of the amount of air bubbles that have accumulated in the print head, and the amount of ink wastage can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-281812, filed Dec. 17, 2010, which is hereby incorporated by reference herein in its entirety.

What is claimed is:

1. A suction-based recovery control method, for an ink jet printing apparatus that includes a print head having a plurality of ejection ports through which to eject ink droplets, a temperature detection unit for detecting an internal temperature of the print head, and a suction-based recovery unit for performing a suction-based recovery operation using either first suction or second suction, the strength of which is stronger than the first suction, in order to recover a state in which the print head ejects ink droplets, comprising:

a temperature detection step for permitting the temperature detection unit to detect the internal temperature of the print head;

a temperature judgment step for judging whether the internal temperature of the print head, detected by the temperature detection unit, is higher, by a predetermined number of degrees or greater, than a reference temperature that is determined based on internal temperatures of the print head that were previously employed when the suction-based recovery operation was performed; and a suction-based recovery step for permitting the suction-based recovery unit to perform the suction-based recovery operation using the second suction, when it is determined at the temperature judgment step that the internal temperature of the print head is higher by the predetermined number of degrees or greater.

2. The suction-based recovery control method according to claim 1, wherein the suction-based recovery operation performed by the suction-based recovery unit is changed in accordance with a difference between the internal temperature of the print head, detected by the temperature detection unit, and the reference temperature.

3. An ink jet printing apparatus comprising:

a print head having a plurality of ejection ports through which to eject ink droplets;

a temperature detection unit for detecting an internal temperature of the print head;

a suction-based recovery unit for performing a suction-based recovery operation using either first suction or second suction, the strength of which is stronger than the first suction, in order to recover a state in which the print head ejects ink droplets;

a judgment unit for judging whether the suction-based recovery unit is to perform the suction-based recovery operation; and a temperature judgment unit for judging whether the internal temperature of the print head, detected by the temperature detection unit, is higher, by a predetermined number of degrees or greater, than a reference temperature that is determined based on internal temperatures of the print head that were previously employed when the suction-based recovery operation was performed, wherein the suction-based recovery unit performs the suction-based recovery operation using the second suction, when the temperature judgment unit has determined that the internal temperature of the print head is higher by the predetermined number of degrees or greater.

4. An ink jet printing apparatus comprising:

a print head configured to discharge ink;

a suction unit configured to perform a suction operation for sucking ink from the print head, the suction unit being capable of performing a first suction operation and a second suction operation that exerts a suction force greater than that by the first suction operation;

a detection unit configured to detect a temperature of the print head; and a control unit configured to cause the suction unit to perform the suction operation based on a suction instruction, the control unit causing the suction unit to perform the second suction operation in the case where the temperature detected by the detection unit is higher than a reference temperature by a predetermined number of degrees or greater, even if the control unit receives the suction instruction for causing the suction unit to perform the first suction operation.

5. The ink jet printing apparatus according to claim 4, wherein the control unit causes the suction unit to perform the first suction operation in the case where the control unit receives the suction instruction for causing the suction unit to perform the first suction operation and the temperature detected by the detection unit is not higher than the reference temperature by the predetermined number of degrees.

6. The ink jet printing apparatus according to claim 4, wherein the control unit causes the suction unit to perform the second suction operation in the case where the control unit receives the suction instruction for causing the suction unit to perform the second suction operation, regardless of the temperature detected by the detection unit.

7. The ink jet printing apparatus according to claim 4, wherein the reference temperature is a temperature of the print head which was detected when the previous second suction operation was performed.

8. The ink jet printing apparatus according to claim 7, wherein the control unit updates the reference temperature when the control unit causes the suction unit to perform the second suction operation.

9. The ink jet printing apparatus according to claim 4, wherein the control unit causes the detection unit to detect the temperature of the print head to update the reference temperature in the case where more than a predetermined time passes since the previous second suction operation was performed.

10. An ink jet printing apparatus comprising:

a print head configured to discharge ink;

a suction unit configured to perform a suction operation for sucking ink from the print head, the suction unit being capable of performing a first suction operation and a second suction operation that exerts a suction force greater than that by the first suction operation;

a detection unit configured to detect a temperature of the print head; and a control unit configured to cause the suction unit to perform the suction operation based on a suction instruction, the control unit causing the suction unit to perform the second suction operation in the case where the temperature detected by the detection unit is higher than a reference temperature by a predetermined number of degrees or greater, if the control unit receives the suction instruction.

11. The ink jet printing apparatus according to claim 10, wherein the control unit causes the suction unit to perform the first suction operation in the case where the control unit receives the suction instruction and temperature detected by the detection unit is not higher than the reference temperature by the predetermined number of degrees.

12. The ink jet printing apparatus according to claim 10, wherein the control unit causes the suction unit to perform the second suction operation in the case where the control unit receives the suction instruction for causing the suction unit to perform the second suction operation, regardless of the temperature detected by the detection unit.

13. The ink jet printing apparatus according to claim 10, wherein the reference temperature is a temperature of the print head which was detected when the previous second suction operation was performed.

14. The ink jet printing apparatus according to claim 13, wherein the control unit updates the reference temperature when the control unit causes the suction unit to perform the second suction operation.

15. The ink jet printing apparatus according to claim 10, wherein the control unit causes the detection unit to detect the temperature of the print head to update the reference temperature in the case where more than a predetermined time passes since the previous second operation was performed.

* * * * *